US005749697A

United States Patent [19]

Davis

[11] Patent Number: 5,749,697

[45] Date of Patent: May 12, 1998

[54] MULTI-PURPOSE MOBILE HOIST

[76] Inventor: Gary E. Davis, Rt. 9 Box 408-D, Statesville, N.C. 28677

[21] Appl. No.: 283,555

[22] Filed: Aug. 1, 1994

[51] Int. Cl.[6] ..... G66F 19/00

[52] U.S. Cl. ..... 414/680; 414/607; 212/253

[58] Field of Search ..... 414/680, 744.2, 414/703, 607, 920; 212/302, 306, 253, 901; 293/116, 117

[56] References Cited

U.S. PATENT DOCUMENTS

| | | | |
|---|---|---|---|
| 2,547,398 | 4/1951 | Lee | 212/253 X |
| 4,067,471 | 1/1978 | Roatcap | 414/703 |
| 4,264,252 | 4/1981 | Jennings et al. | 414/920 X |
| 4,881,864 | 11/1989 | Amato | 414/543 |
| 5,211,526 | 5/1993 | Robinette | 414/550 |

*Primary Examiner*—Donald W. Underwood
*Attorney, Agent, or Firm*—Cort Flint

[57] ABSTRACT

A boom hoist is disclosed having top and bottom mast sections joined together midway of an upstanding mast at a swivel joint defined by mating flange faces where the top mast section rotates about a central core extending into each mast section. A boom arm is pivotally carried by the top mast section and a universal attachment base is carried by the bottom mast section having a tongue connection for connecting the hoist to a plurality of associated structures for hoist operation. Advantageously, a side mount assembly for mounting the hoist near a side of a vehicle, a three-point hitch mount assembly for mounting the hoist to a farm tractor, a fork lift mount assembly, a floor mount assembly, and a roller frame mount assembly are provided for the hoist.

21 Claims, 6 Drawing Sheets

MULTI-PURPOSE MOBILE HOIST

BACKGROUND OF THE INVENTION

This invention relates to a mobile hoist apparatus and more particularly to a multi-purpose hoist which may be readily reconfigured for use with a plurality of implements.

Previously, mobile cranes of the boom hoist type have been provided for use with various type vehicles such as pickup trucks, station wagons, and wheeled platforms. For example, U.S. Pat. No. 5,211,526 discloses a mobile crane which attaches to a vehicle trailer hitch drawbar, or may be reconfigured in the form of a crane on a roll about stand. However, the problem occurs in such a crane that the swivel point for the column is substantially near the bottom of the crane producing a large movement arm when the crane is loaded about the swivel, and associated structural parts for mounting the crane. Further, the mount of the crane to the vehicle and roller stand limits the other useful implements to which the crane may be mounted. U.S. Pat. No. 4,881,864 discloses a boom hoist for attachment to a trailer hitch drawbar wherein an elongated tubular stanchion is provided extending generally the entire vertical length of the hoist. A top sleeve fits over the stanchion which rests upon a collar which is affixed to the stanchion. The sleeve rotates about the collar. While this alleviates somewhat the problem of large movement forces on a lower swivel portion of the stanchion, the hoist may not be broken down into shorter lengths for transportation and reconfiguration owing to the need for a continuous stanchion over the height of the hoist.

Accordingly, an object of the invention is to provide a multi-purpose mobile hoist which can be easily and conveniently reconfigured for use with a number of associated implements such as vehicles, wheeled stands, and other associated structures.

Another object of the present invention is to provide a hoist which may be rotated to a variety of fixed positions yet which has increased structural integrity for use with a wide variety of associated implements.

Another object of the invention is to provide a boom hoist having increased structural integrity yet which may be easily taken apart for transportation and storage, and for moveability in being used with a variety of implements.

Yet another object of the invention is to provide a boom hoist having increased structural integrity which may be utilized with a socket-type trailer hitch mount.

SUMMARY OF THE INVENTION

The above objectives are accomplished according to the invention by providing a multi-purpose boom hoist for use with a variety of implements having a universal mounting socket affixed to an associated structure. The hoist comprising an upstanding mast having a bottom mast section and a top mast section; and an elongated retaining core disposed within at least a portion of the top and bottom mast sections about which the top mast section rotates. A bottom load bearing flange is carried by an upper end of the bottom mast section. A top flange is carried by a lower end of the top mast section. The top and bottom flanges mate together in a rotational relationship; and a lock is carried with the flanges for locking the top and bottom flanges together in a desired rotational position. A cantilevered boom arm is carried by an upper end of the top mast section; and a base is carried by a lower end of the bottom mast section having a tongue which slidably fits with the socket of the associated structure for supporting the mast in a generally upright operating position. The bottom mast section and the top mast section have a length generally equal to about one-half of the height of the upstanding mast. The retaining core has a length generally equal to about one-half of the upstanding mast, and preferably extends generally equally into the top and bottom mast sections.

The hoist may be used in combination with a number of implements. A side mount assembly is provided for mounting the boom hoist near a side of a vehicle having a trailer hitch. The side mount assembly includes a tongue which is affixed to the vehicle trailer hitch, a generally horizontal beam extending transversely to the tongue terminating near the side of the vehicle, and a socket carried by the horizontal beam for connecting with the tongue of the hoist. At least one stabilizer leg depends downwardly near the socket for supporting the side mount assembly and hoist above the ground.

The invention includes a three-point hitch mount assembly for mounting the boom hoist to a conventional three-point hitch of the type having a drawbar and a pivotal stabilizer bar. The mount assembly includes a socket, and a hitch connector carried by the socket for attachment to the drawbar. A stabilizer bar connector is carried by the mast for connection to the stabilizer bar of the three-point hitch. A forklift mount assembly is also provided for mounting the boom hoist to a conventional forklift vehicle. The forklift mount assembly comprises a socket for receiving the tongue of the hoist, a hitch connector for connecting to the trailer hitch of the forklift, and a stabilizer leg depending downward from the socket for engaging a rear surface of the forklift vehicle. A floor mount is provided for supporting the boom hoist on a floor support. The floor mount comprises a floor frame having at least two horizontal beams supported by a plurality of floor legs, and a longitudinal beam spanning the two horizontal beams. A socket is carried by a portion of the longitudinal beam for receiving the tongue of the hoist, and an elongated support surface for supporting a remainder of the base of the hoist which does not include the hoist tongue. A wheeled frame mount assembly is provided for supporting the boom hoist. The wheeled frame mount includes a base having at least two horizontal beams, and a socket spanning the horizontal beams being affixed to the beams. The tongue of the hoist is received in the socket. A pair of bolted legs are affixed and extend outward from the frame, and a plurality of wheels carried by the legs in base frame.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 5 is a perspective view illustrating a boom hoist according to the invention in combination with a standard three-point trailer hitch of a tractor vehicle and the like.

DESCRIPTION OF A PREFERRED EMBODIMENT

Figure 1:
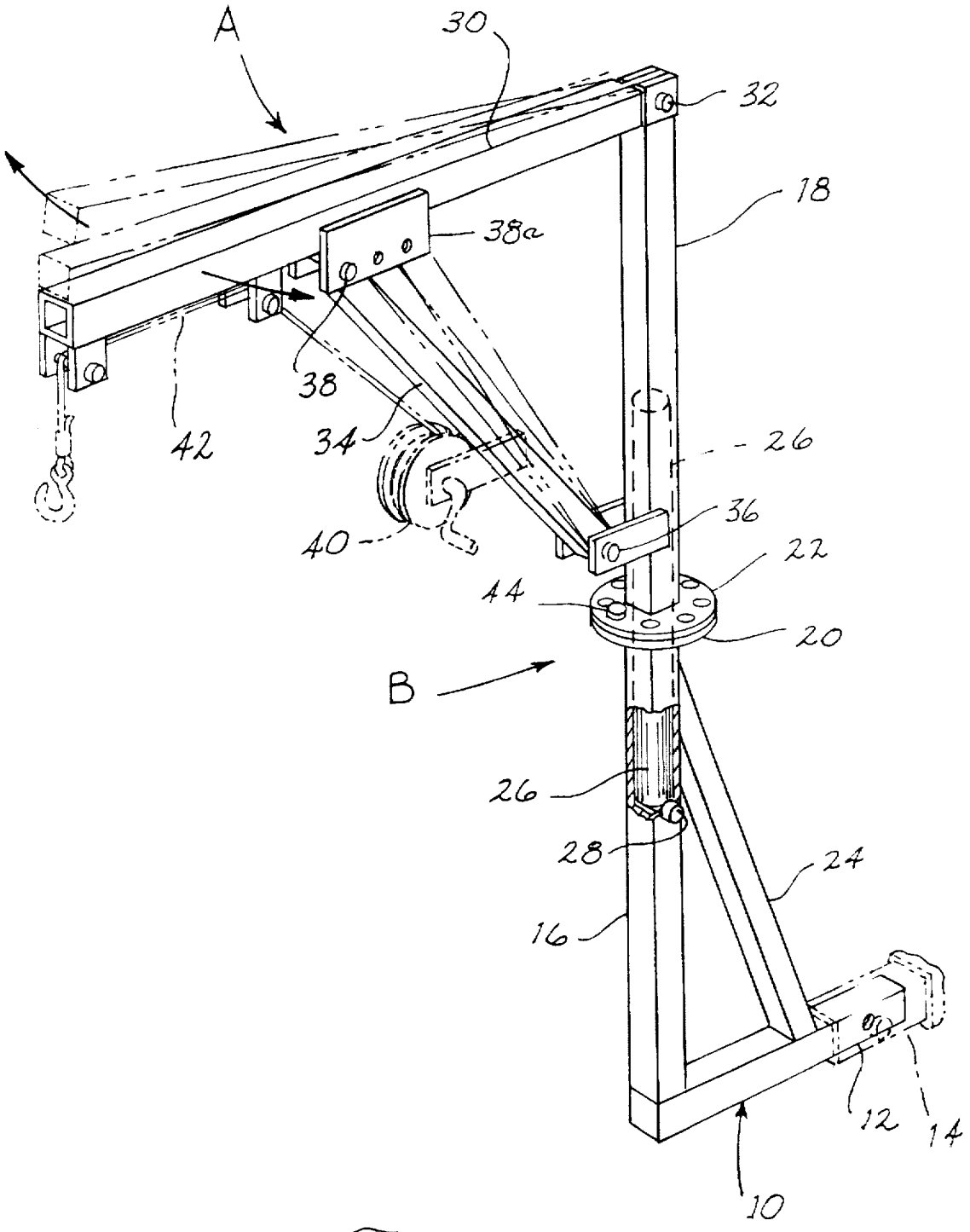
FIG. 1 is a perspective view illustrating a boom hoist constructed according to the present invention.

Referring now in more detail to the drawings, a boom hoist, designated generally as A is illustrated in FIG. 1 which includes a base 10 having a tongue 12 which is received within a mounting socket 14 of an associated structure. Affixed to the forward end of base 10 is a vertical mast, designated generally as B, which includes a bottom mast section 16 and a top mast section 18. Affixed to a free end of the bottom mast section is a load bearing flange 20. Affixed to a free end of top mast section 18 is a corresponding flange 22 having a bearing surface which mates with a face of flange 20. A first brace, which includes a tubular brace 24, extends between base 10 and bottom mast section 16, having free ends affixed, such as by welding, to base 10 and to mast section 16 near flange 20. By using a brace 24 consisting of square tubing affixed as shown, the hoist is effectively braced against twisting movements encountered as the hoist is rotated underload.

Received within mast sections 16 and 18 is a central retaining core 26 which has a considerable length extending into each mast section. Mast sections 16 and 18 are preferably square tubing with retaining core 26 being cylindrically disposed with close tolerances within the hollow square interior of the tubing. A stop pin 28 may be welded in bottom mast section 16 for retaining core 26. In this manner, retainer core 26 may be a separable piece and easily removed for breakdown and moving of the hoist when reconfigured with various implements. Alternately, core 26 may be welded in place where additional strength is required.

A boom arm designated 30 is pivotally attached to an outer end of top mast section 18 by means of a pivot bolt 32. A second brace 34 is pivotally attached to top mast section 18 near flange 22 and extends upwardly and outwardly to a pivot affixed to boom arm 30. A plurality of pivot attachments 38 is provided for attachment of the remote end of brace 34 by spaced apart flange plates **38*a* so that the cantilevered position of boom arm 30 may be tilted. This may be useful in allocating the load and also in clearance when used with associated structures. A wench shown in dotted lines 40 and associated wench cable 42** may be utilized in a conventional manner for lifting and lowering loads.

Preferably, the hoist elements described above comprise square tubing, except where specifically described otherwise, joined together by any suitable means such as welding.

Thus, it can be seen that a highly advantageous construction for a hoist boom can be had according to the invention wherein a vertical mast B is provided in two half sections 16 and 18 which have generally equal heights. A retaining core 26, again having a dimension roughly equal to half the height of the mast, is inserted inside of the mast sections. By this means, a mast for a boom hoist is providing having significantly improved structural integrity. The swivel joint which allows the boom arm to swing to a variety of rotational positions is located about midway of the mast and the moment arm is reduced about the swivel. A plurality of apertures (45 degrees apart) are fixed in the flange plates 22 and 20 to receive a bolt 44 by which the top mast section may be rotated relative to the bottom mast section to fix the relative position of the boom arm. The boom arm may be swung freely as when moving a load over the ground to a load vehicle or other load structure.

Figure 2:
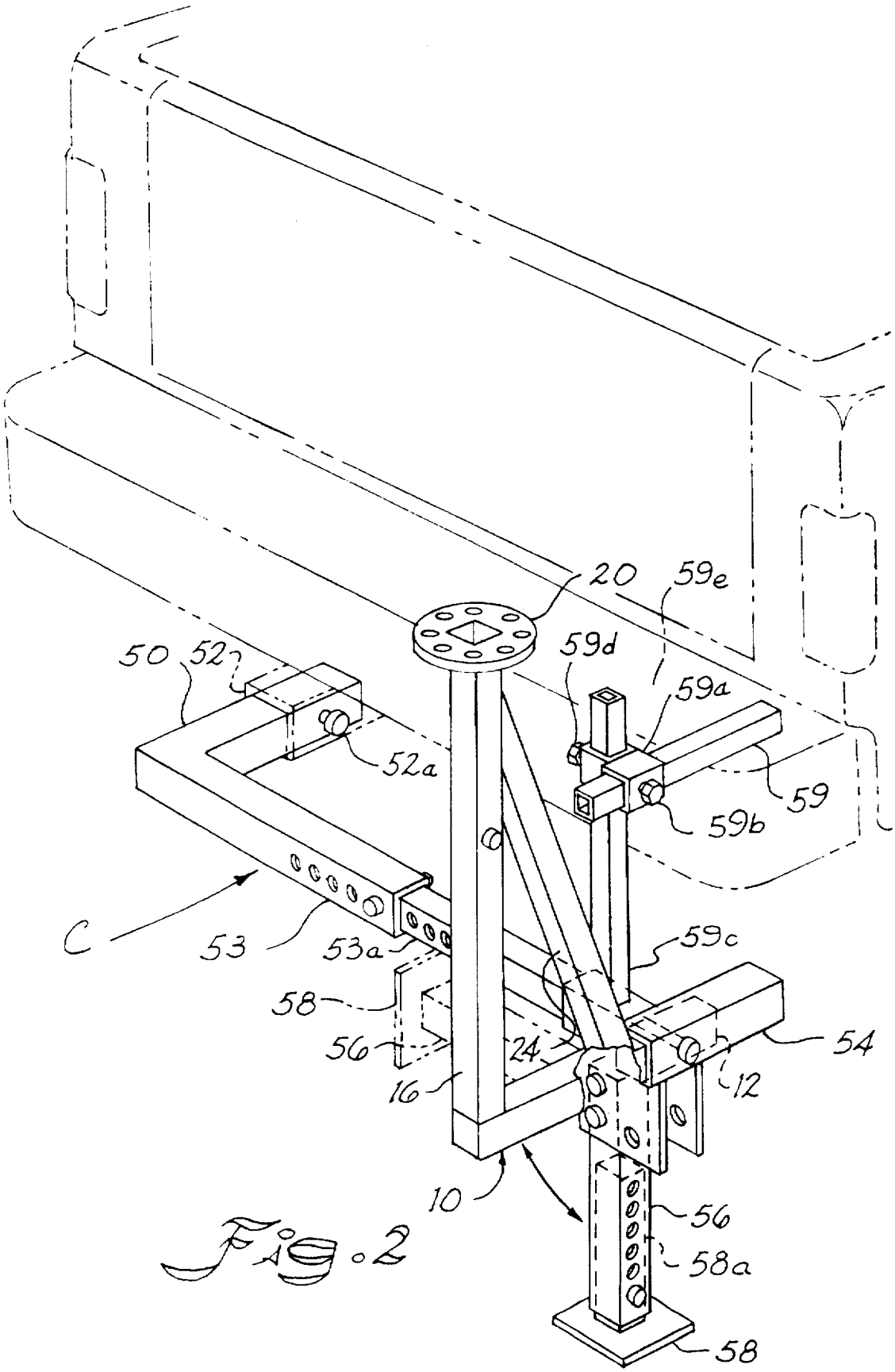
FIG. 2 is a right rear perspective view illustrating a boom hoist according to the invention in combination with a side mount for a vehicle having a drawbar hitch.

As can best be seen in FIG. 2, a side mount assembly is illustrated with which the boom hoist may be utilized in one advantageous embodiment of the invention. The side mount assembly, designated generally as C, includes a tongue 50 received in a trailer hitch socket 52 of a conventional drawbar trailer hitch, which in the illustrated embodiment is attached to a pickup truck vehicle. Tongue 50 terminates in a beam 53 of square tubing extending at right angle to the tongue. A telescoping, adjustable leg **53*a* is received in leg 53 and locked in place by a bolt/hole arrangement. At the remote end of beam 53 is a socket 54 which receives tongue 12 of hoist A. Extending downwardly below socket 54 is at least one stabilizer leg 56 having a telescoping foot 58 affixed to a telescoping shaft 58*a* which may be adjusted to a suitable height using any conventional arrangements such as the illustrated locking pin and hole arrangement. Any other suitable means such as a screw jack may be utilized for extending and retracting telescoping foot 58. In this manner, boom hoist A may be utilized on the side of the vehicle to lift articles outside of the vehicle truck bed, whereon mast section 18 and boom arm 30 may be swivelled about flanges 20, 22 over the pickup bed for loading (or unloading) the article into the bed. This is particularly advantageous since the side mount provides an unobstructive delivery over the tailgate of the vehicle or its side. For example, the vehicle may be driven along side the article to be loaded, and then the article may be lifted and swung into the bed from the side of the bed in a quick and easy manner. The side mount may be constructed to mount to either the right or left side of the vehicle. For this purpose, stabilizing leg 56 can be made to reverse so that the entire side mount assembly may be rotated 180° and placed on the left side. Other alternate arrangements may also be had. In addition, a stabilizer mechanism is provided by a horizontally adjustable leg 59 whose position is set in a bracket 59*a* by a set screw 59*b*. Bracket 59*a* is in turn carried on a vertical leg 59*c* and fixed on the leg at a desired vertical position by set screw 59*d*. When the vehicle is driven in transit, leg 53*a* is adjusted inwardly so horizontal leg 59 is over the top surface of bumper 59*e*. Leg 59 is then adjusted downwardly to abut and overlie bumper 59*e*** for support and stability during transit.

Figure 3:
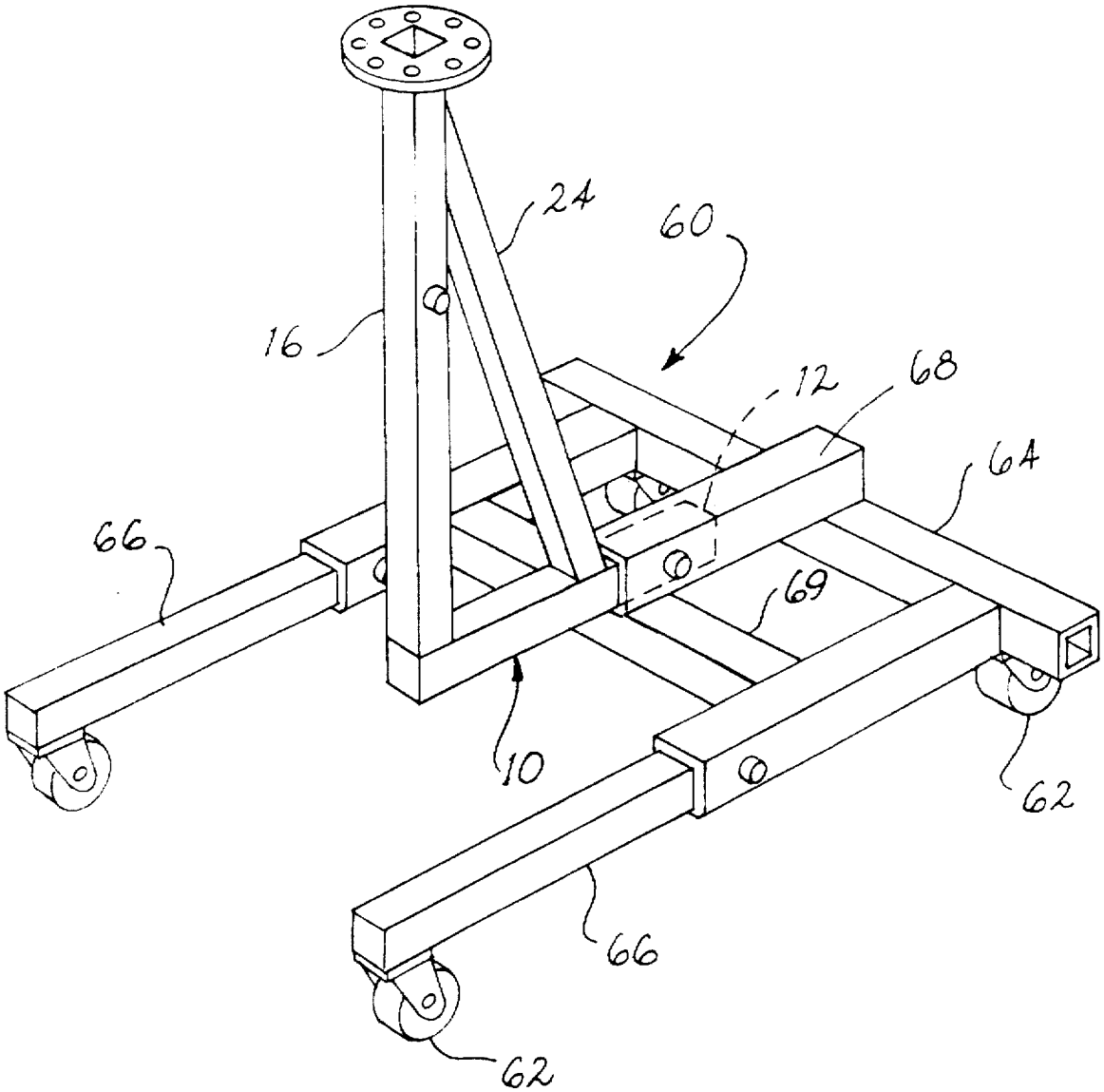
FIG. 3 is a perspective view illustrating a roller stand for a boom hoist according to the invention.

As can best be seen in FIG. 3, a roller frame assembly, designated generally as 60, is provided having four rollers 62. Two of the rollers are carried on an angle frame element 64 and the remaining rollers are carried on frame legs 66. A socket 68 for receiving tongue 12 of the boom hoist is provided, as well as a cross beam 69 for supporting the socket, at a spaced location. Again, conventional lock pins and holes may be utilized to lock the telescoping legs in place.

Figure 4:
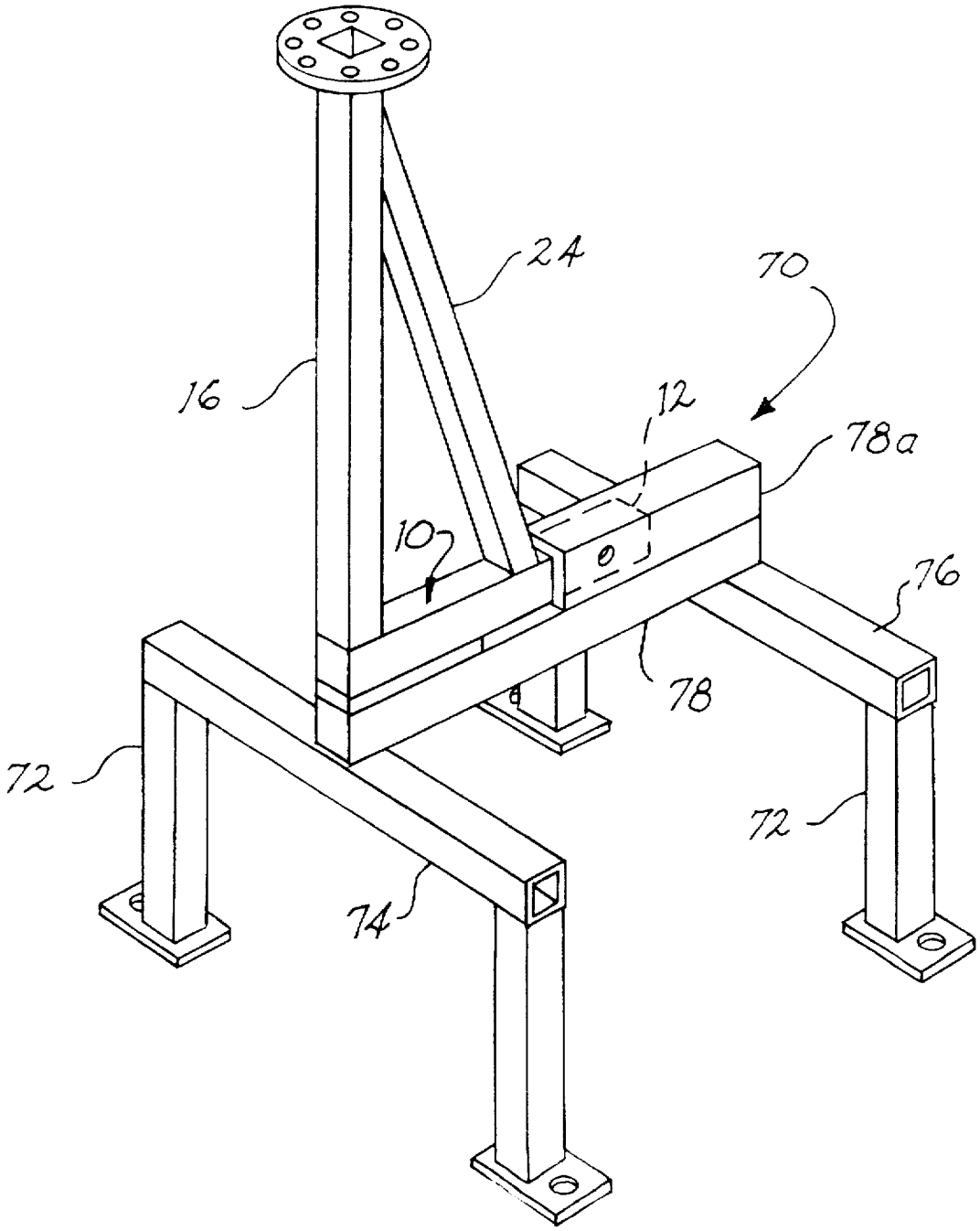
FIG. 4 is a perspective view illustrating a floor stand in combination with a boom hoist according to the invention.

In FIG. 4, a floor stand assembly, designated generally as 70 is illustrated which includes four legs 72 depending down from cross beams 74 and 76. A longitudinal beam 78 supports a socket **78*a* which receives tongue 12 of boom hoist A. Base 10 is received on the remaining length of longitudinal beam 78** defining a beam support, as can best be seen in FIG. 4, whereupon the entire base of the hoist is supported.

Figure 5:
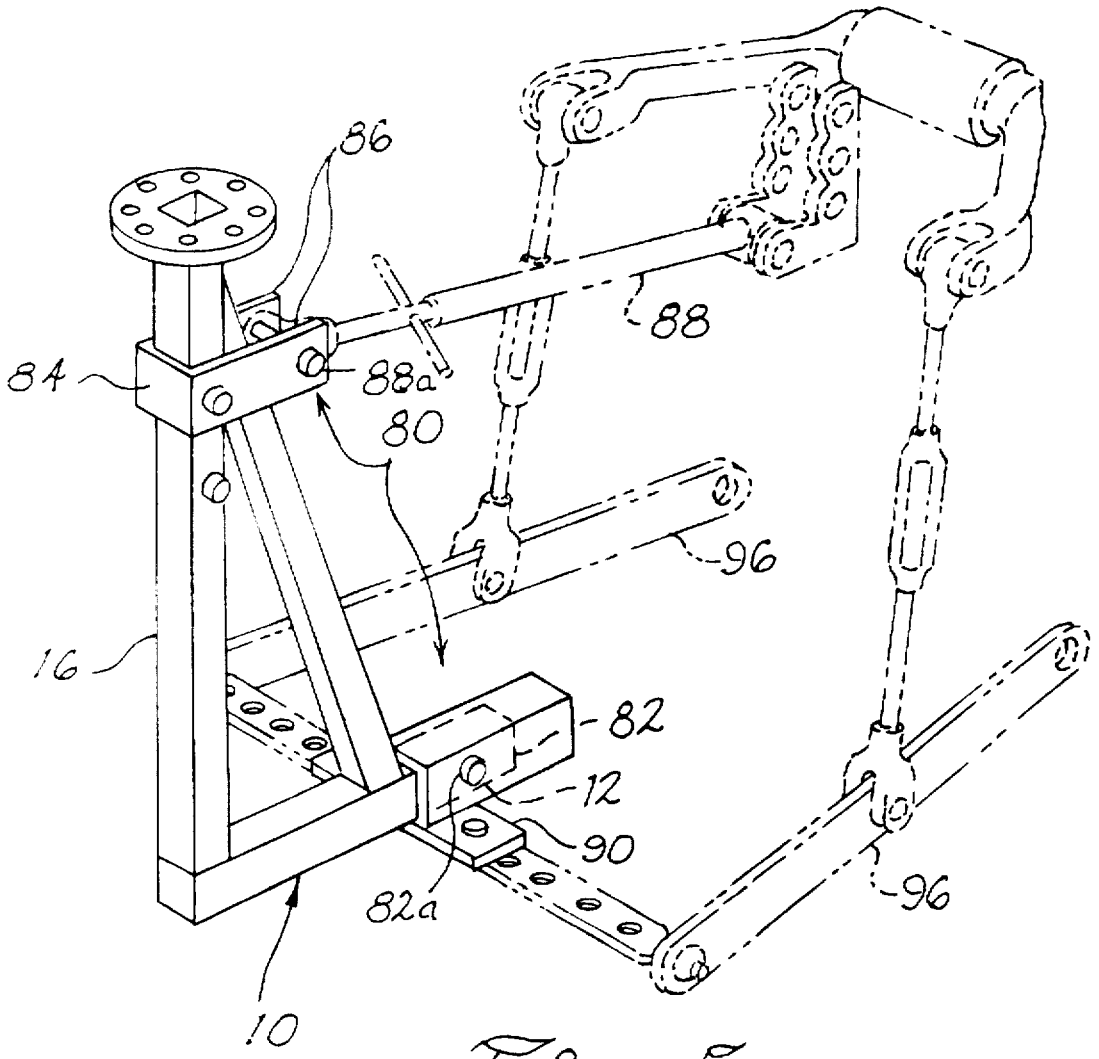

FIG. 5 illustrates a particular advantageous embodiment of an implement with which boom hoist A of the present invention may be utilized. In this illustrated embodiment, a conventional three-point hitch, such as found on a farm tractor, is provided with a three-point hitch mount assembly, designated generally as 80, which includes a socket 82 which receives tongue 12 of hoist A with a locking pin **82*a*** extending through the tongue. A mounting bracket 84 is attached to bracket mast section 16, and includes a fork 86 which straddles the square tubing and connects to a stabilizer bar 88 of a conventional three-point hitch. For this purpose, a pin 88*a* is provided. Extending laterally on both sides of socket 82 is a connector element 90 mounted to a drawbar 94 of the three-point hitch assembly in a conventional manner such as by bolts. Drawbar 94 is supported by stabilizer arms 96 of a typical three-point hitch. Thus, it can be seen that an advantageous embodiment of the invention can be had wherein the lift hoist may be utilized for agricultural and other purposes as an implement to any utility vehicle having a three-point hitch. Top mast section 18 and boom arm 30 may be swivelled about the bottom mast section 16 in 360° of rotation for loading and unloading.

Figure 6:
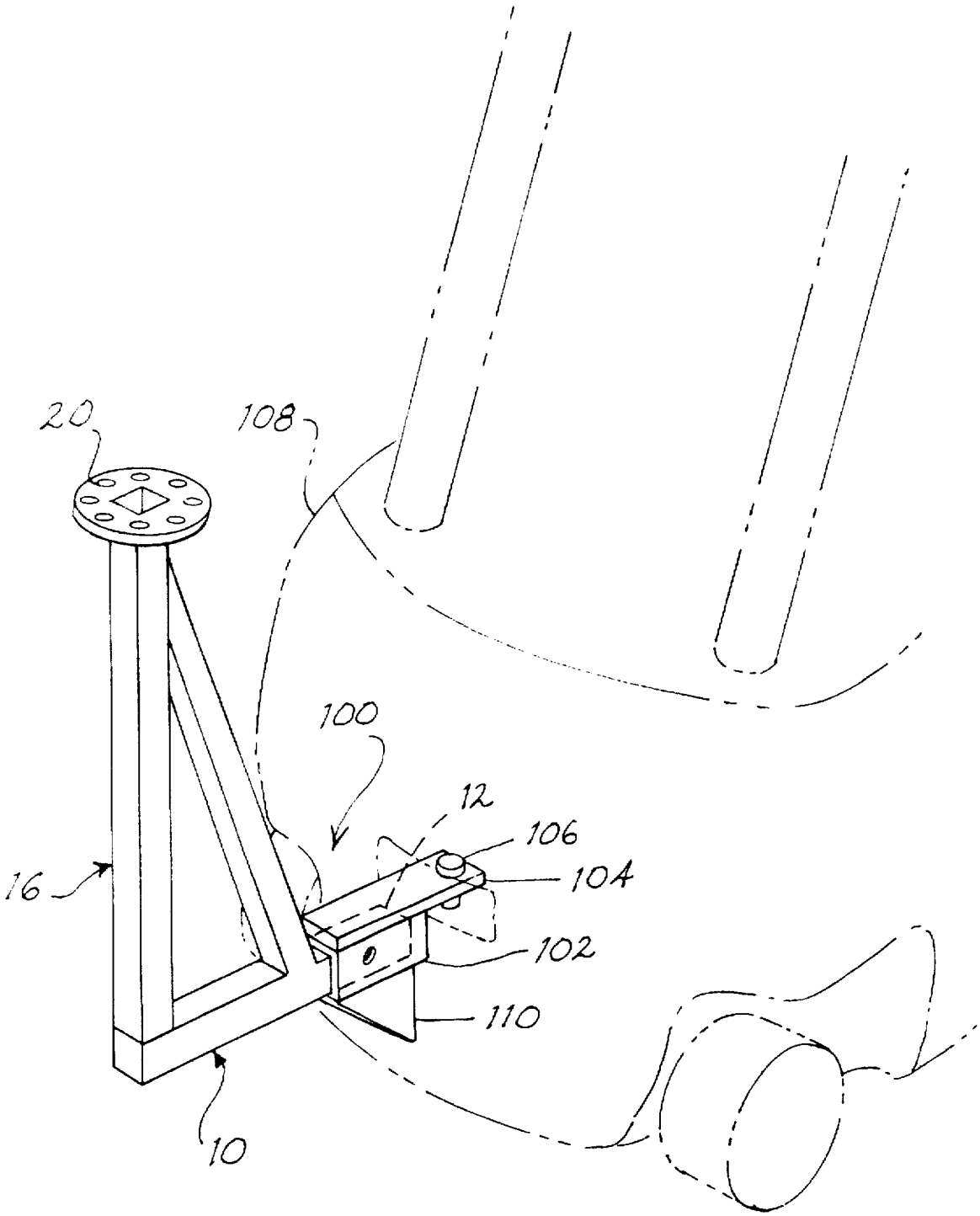
FIG. 6 is a perspective view illustrating the boom hoist of the present invention in combination with a mount to a conventional fork lift vehicle.

In industrial applications, boom hoist A of the present invention may be advantageously utilized by providing a fork lift mount assembly designated generally as 100 having a socket 102 which receives tongue 12 with a lock pin (not shown) extending through the tongue. A hitch element 104 is affixed to socket 102 and mounted by means of a hitch pin 106 to a conventional aperture trailer hitch of a forklift vehicle on a conventional forklift vehicle 108. A web 110 is affixed to tongue 102, such as by welding and bears against a rear surface of the forklift vehicle to stabilize and support the forklift mount assembly when base 10 and hoist A are mounted, as can best be seen in FIG. 6.

Thus it can be seen by an advantageous construction for a multi-purpose boom hoist can be had for use with various implements according to the invention wherein 360° rotation is provided by a swivel boom arm yet significant structural integrity is provided to boom mast B.

It may also be desirable in some applications to provide a stabilizer for hoist A when in operation. For this purpose, a stabilizer assembly (not shown) may be provided having a horizontal beam with a pair of upstanding legs which straddle base 10 of the hoist. On opposing ends of the beam, approximately 3 feet apart, conventional trailer jacks may be affixed to the beam having telescoping legs which extend and retract vertically upon turning the screw handle of the jack. In this manner, the vertical legs of the beam may be placed underneath base 10 of the hoist to straddle the base (and pin locked), and the legs of the stabilizer may be extended until the horizontal beam is wedged up under the hoist tightly.

While a preferred embodiment of the invention has been described using specific terms, such description is for illustrative purposes only, and it is to be understood that changes and variations may be made without departing from the spirit or scope of the following claims.

What is claimed is:

1. A multi-purpose boom hoist for use with a variety of implements having a mounting socket affixed to an associated structure and with a conventional forklift vehicle having a trailor hitch, said hoist comprising:

an upstanding mast having a bottom mast section and a top mast section;

an elongated retaining core disposed within at least a portion of said top and bottom mast sections about which said top mast section rotates;

a bottom load bearing flange carried by an upper end of said bottom mast section;

a top flange carried by a lower end of said top mast section;

said top and bottom flanges mating together in a rotational relationship;

a lock carried with said flanges for locking said top and bottom flanges together in a desired rotational position;

a cantilevered boom arm carried by an upper end of said top mast section;

a base carried by a lower end of said bottom mast section having a tongue which slidably fits with said socket of said associated structure for supporting said mast in a generally upright operating position; and a forklift mount assembly for mounting said boom hoist to said conventional forklift vehicle; and said forklift mount assembly comprising a socket for receiving said tongue of said hoist, a hitch connector supporting said socket for connecting to said trailer hitch of said forklift, and a stabilizer carried by said socket for engaging a rear surface of said forklift vehicle.

2. The hoist of claim 1 including a bottom brace extending at an angle between said base and said bottom mast section, and a top brace extending at an angle between said top mast section and said boom arm.

3. The hoist of claim 2 wherein said bottom brace is affixed to said bottom mast section near said bottom flange, and said top brace is affixed to said top mast section near said top flange.

4. The hoist of claim 3 wherein said bottom mast section and said top mast section each have a length generally equal to about one-half of the height of said upstanding mast.

5. The hoist of claim 4 wherein said retaining core has a length generally equal to about one-half of the height of said upstanding mast, and extends generally equally into said top and bottom mast sections.

6. The hoist of claim 1 wherein said bottom mast section and said top mast section are generally equal in length.

7. The hoist of claim 1 wherein said retaining core has a length generally equal to about one-half of the height of said upstanding mast, and extends generally equally into said top and bottom mast sections.

8. The hoist of claim 1 wherein said bottom mast section and said top mast section each have a length generally equal to about one-half of the height of said upstanding mast.

9. The hoist of claim 1 including a pivot pivotally connecting said boom arm to said top mast section, and an adjustable top brace extending between said top mast section and said boom arm, and an adjustable attachment for affixing said remote end of said top brace to said boom arm at a variety of positions so that said boom arm may be fixed in a desired tilted position relative to said top mast section.

10. The hoist of claim 1 including a lock pin for fastening said tongue and any one of said sockets together.

11. The hoist of claim 1 comprising a wheeled frame mount for supporting said boom hoist, said wheeled frame mount including a base having at least two horizontal beams, a socket spanning said horizontal beams being affixed to said beams, said tongue of said hoist being received in said socket, a pair of telescoping legs extending outward from said base, and a plurality of wheels carried by said telescoping legs and said base.

12. A multi-purpose boom hoist for use with a variety of implements having a mounting socket affixed to an associated structure, said hoist comprising:

an upstanding mast having a top mast section and a bottom mast section;

a swivel joint about which said top mast section rotates relative to said bottom mast section;

a cantilevered boom arm carried by an upper end of said top mast section;

a base carried by a lower end of said bottom mast section having a tongue which slidably fits with said socket of said associated structure for supporting said mast in a generally upright operating position;

a side mount assembly for mounting said boom hoist near a side of a vehicle having a trailer hitch; and said side mount assembly including a tongue for connection to said vehicle trailer hitch, a generally horizontal beam extending transversely to said tongue terminating near said side of said vehicle, a connector carried by said horizontal beam for connecting with said tongue of said hoist, and at least one stabilizer leg depending downwardly near said connector for supporting said side mount assembly and hoist above the ground.

13. The hoist of claim 12 wherein said swivel joint includes a bottom load bearing flange carried by an upper end of said bottom mast section;

a top flange carried by a lower end of said top mast section;

said top and bottom flanges mating together in a rotational relationship; and a lock carried with said flanges for locking said top and bottom flanges together in a desired rotational position.

14. The hoist of claim 12 wherein said stabilizer leg comprises a telescoping foot whose vertical position may be adjusted as necessary and fixed in said adjusted position for supporting and stabilizing said side mount assembly with said boom hoist mounted.

15. The hoist of claim 12 wherein said horizontal beam has a length which is adjustable in a lateral direction relative to said vehicle.

16. The hoist of claim 12 wherein said side mount assembly comprises a stabilizer mechanism carried by said horizontal beam for engaging a bumper of said vehicle during transit operation.

17. The hoist of claim 12 wherein said bottom mast section and said top mast section have a length generally equal to about one-half of the height of said upstanding mast; an elongated retaining core disposed within at least a portion of said top and bottom mast sections about which said top mast section rotates; said retaining core has a length generally equal to about one-half of the height of said upstanding mast, and extends generally equally into said top and bottom mast sections.

18. A multi-purpose boom hoist comprising:

an upstanding mast having a top mast section and a bottom mast section;

a swivel joint about which said top mast section rotates relative to said bottom mast section;

a cantilevered boom arm carried by an upper end of said top mast section;

a base carried by a lower end of said bottom mast section having a hoist tongue;

a three-point hitch mount assembly for mounting said boom hoist to a conventional three-point hitch of the type having a drawbar and a pivotal stabilizer bar; and said mount assembly includes a connector socket for connection to said hoist tongue, a hitch connector carried by said connector socket for attachment to said drawbar, and a stabilizer bar connector adapted to be carried by said mast for connection to said stabilizer bar of said three-point hitch.

19. The hoist of claim 18 wherein said swivel joint includes a bottom load bearing flange carried by an upper end of said bottom mast section;

a top flange carried by a lower end of said top mast section;

said top and bottom flanges mating together in a rotational relationship; and a lock carried with said flanges for locking said top and bottom flanges together in a desired rotational position.

20. The hoist of claim 18 wherein an elongated retaining core disposed within at least a portion of said top and bottom mast sections about which said top mast section rotates.

21. A multi-purpose boom hoist for use with a variety of implements having a mounting socket affixed to an associated structure, said hoist comprising:

an upstanding mast having a bottom mast section and a top mast section;

an elongated retaining core disposed within at least a portion of said top and bottom mast sections about which said top mast section rotates;

a bottom load bearing flange carried by an upper end of said bottom mast section;

a top flange carried by a lower end of said top mast section;

said top and bottom flanges mating together in a rotational relationship;

a lock carried with said flanges for locking said top and bottom flanges together in a desired rotational position;

a cantilevered boom arm carried by an upper end of said top mast section;

a base carried by a lower end of said bottom mast section having a tongue which slidably fits with said socket of said associated structure for supporting said mast in a generally upright operating position; and a floor mount for supporting said boom hoist on a floor support, said floor mount comprising a floor frame having at least two horizontal beams supported by a plurality of floor legs, a longitudinal beam spanning said two horizontal beams, a socket carried by a portion of said longitudinal beam for receiving said tongue of said hoist, and an elongated support surface for supporting a remainder of said base of said hoist which does not include said hoist tongue.

* * * * *